United States Patent [19]

Smith et al.

[11] 3,949,913

[45] Apr. 13, 1976

[54] HOSIERY HANDLING SYSTEM WITH U-SHAPED FORM

[75] Inventors: Gus T. Smith; Clifton Gregory, both of Paducah, Ky.; Lester W. Campbell, Claremont, N.C.

[73] Assignee: Marvel Specialty Company, Hickory, N.C.

[22] Filed: Nov. 26, 1974

[21] Appl. No.: 527,441

[52] U.S. Cl. ..... 223/43
[51] Int. Cl.[2] ..... A41H 43/00
[58] Field of Search ..... 223/39–43

[56] References Cited

UNITED STATES PATENTS 3,044,669 7/1962 Kienel ..... 223/43

*Primary Examiner*—G. V. Larkin
*Attorney, Agent, or Firm*—Lowe, King, Price & Markva

[57] ABSTRACT

A hosiery inspecting, everting, separating and stacking apparatus including a U-shaped, elongated, tubular form axially pivoted adjacent one end for oscillatory movement in a vertical plane between a loading, intermediate inspecting and everting position and a separating and stacking position. Hosiery from a knitting machine is placed on the U-shaped tubular form in the loading position while still in a continuous string. Pulling the hosiery on the form over the open end and bunching the string on the form is facilitated by inducing egress of air during the loading operation. The form containing the hosiery string is moved during each cycle from the inspecting position where everting is performed by vacuum to a separating position where separation is preferably formed by a pulling-off operation with breaking of a knitted connector ring attaching the hose to the string. Grasping fingers of the pulling and stacking apparatus grip the hosiery which is doubled over on itself at the open end of the tube and pull the everted hose from the form to move the same to a stacking station. The reversible air system and the pulling and stacking apparatus is automatically actuated by switches responsive to movement of the tubular form. The switches are mounted adjacent the support bearing and are responsive to a cross bar carried by the vertically oscillating form.

11 Claims, 7 Drawing Figures

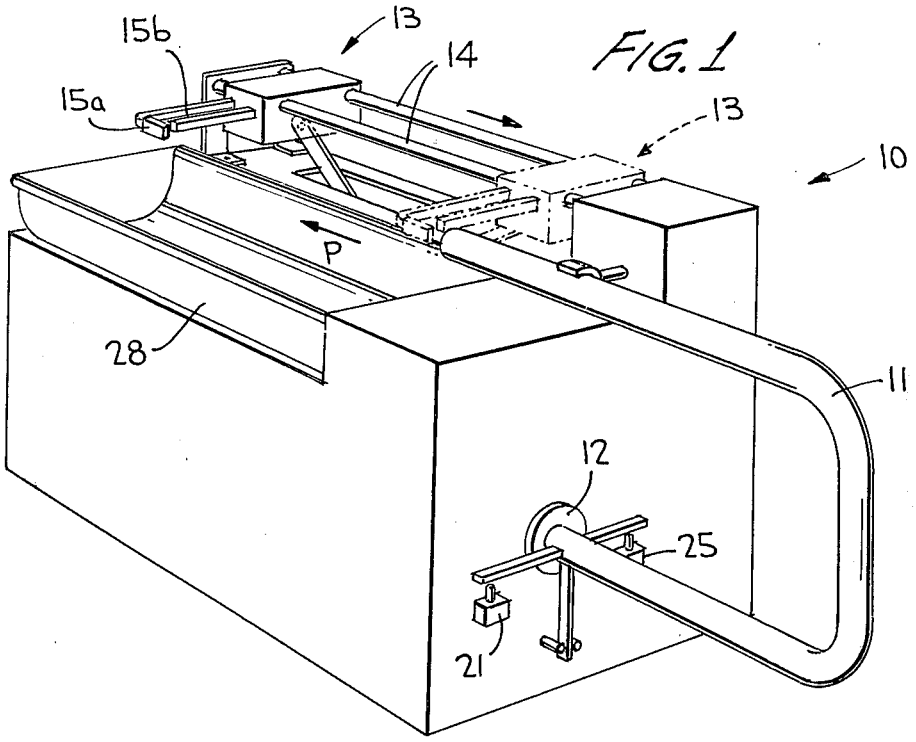
FIG. 1
FIG. 2
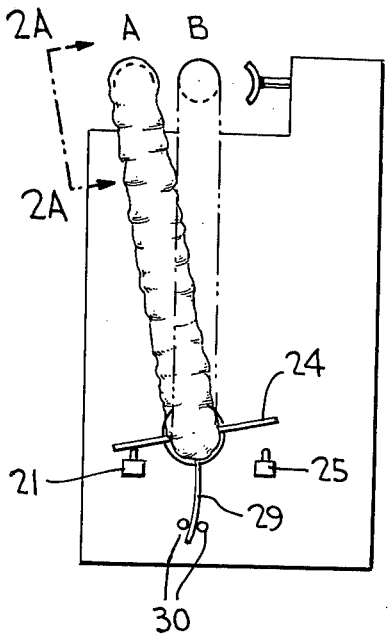
FIG. 2a
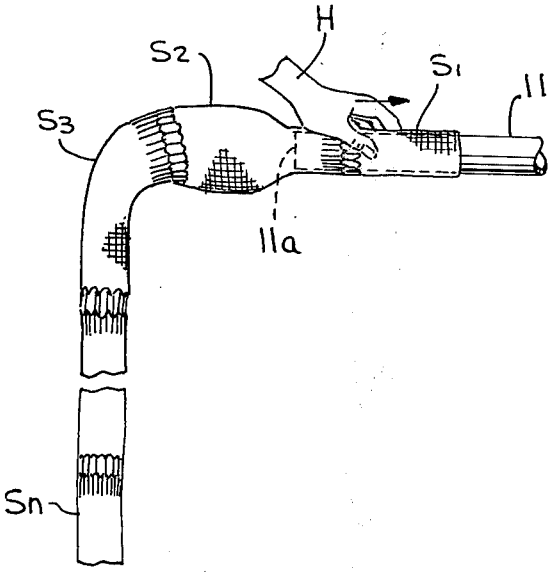

HOSIERY HANDLING SYSTEM WITH U-SHAPED FORM

FIELD OF THE INVENTION

The present invention relates to handling of hosiery during the manufacturing process, and more particularly, to an improved arrangement wherein the individual hose are turned, separated from the string, pulled off the turning form and stacked.

BACKGROUND OF THE INVENTION

During the manufacture of hosiery, particularly socks, it is common practice to knit the hosiery in a continuous elongated tube divided by longitudinally spaced transverse knitted rings of break-away thread. This facilitates the turning and separation of each hose in turn that is required before the further processing can proceed. This preliminary step has typically been performed by simply grasping the first in-line hose in one hand and the remainder of the string in the other, everting the first hose and pulling the two apart. In the next processing step, which is generally the sewing or closing of the toe, the hosiery is thus separated and is inside-out for the seamstress.

Prior art devices using a tubular form for inspecting, turning and separating suffer one disadvantage in that the number of hose on a string to be separated is limited by the length of the machine. Lengthening of the form and machine to accommodate a greater number of hose has not been practical due to limited space available in the manufacturing plant. A long horizontal form, utilizes a large amount of costly floor space and for this reason is unacceptable.

Also, the operator of prior machines has had to be relied upon to consciously perform either through a foot pedal or a hand lever, at least one of the switching operations of the machine. This slows and fatigues the operator considerably, and thus engenders inefficiency.

OBJECTS OF THE INVENTION

It is thus an object of this invention to provide an improved apparatus of simple and relatively inexpensive design for more efficiently turning and separating hosiery.

Another object is to provide an improved apparatus for turning and separating hosiery where loading operations and manual handling are minimized.

A further object is to provide a turning and separating apparatus which has a greater loading capacity, takes up less floor space and has greater output capability and efficiency than prior art devices.

A still further object of the invention is to provide a turning and separating apparatus wherein a greater holding capacity is made possible by a novel U-shaped configuration of the tubular form.

Another object is to provide a combination of a reversible air system and a sequencing circuit for the pulling and stacking apparatus that is automatically operated by merely proper positioning of the form.

It is another object of the invention to provide a turning and separating apparatus wherein the greater efficiency is also made possible by a U-shaped tubular form, and the greater output capability is accomplished by the form being vertically oscillated between a loading and separating position.

BRIEF DESCRIPTION OF THE INVENTION

Apparatus is described in the application for efficiently turning, separating and stacking hosiery which includes a novel, U-shaped tubular form for supporting the string of hosiery. The U-shaped form is pivotally mounted for movement in a vertical plane. A cross bar adjacent the mounting bearing on the form mechanically actuates electrical control means for controlling ingress and egress of air through an open end of the form. Egress of air through the open end of the form is used to pre-open the string and reduce the frictional resistance. Ingress of air is used for drawing the hosiery into the form and thereby everting the hosiery. Another switch, operated by the same cross bar, activates the sequencing circuit for the pulling and stacking assembly.

An important feature of this invention is that the U-shaped tubular form is supported at one end in the horizontal bearing which permits oscillating movement of the tubular form in a vertical plane. The form moves from an outward loading position to an intermediate inspecting and turning position and then to an inward separating position. As mentioned, both the air system and separating means are automatically cycled as the tubular form is bodily oscillated through these positions.

As the hose separates and moves off the end of the form, it is delivered in the same motion over a stacking station and released, forming a stack ready for tying into a bundle after a predetermined number has been stacked.

The apparatus used for the separating means may comprise a pair of fingers adapted to be positioned on opposite sides of a flattened side of the mouth of the form. The hose is stopped short of a full turn so that a doubled over position of the hose is thereby gripped. The separating fingers are carried on a carriage that slides horizontally on tracks from a separating to a stacking position. The carriage may be driven by a hydraulic cylinder, endless chain, crank and lever means or other driving system.

Still other objects and advantages of the present invention will become readily apparent to those skilled in the art from the following detailed description, wherein I have shown and described only the preferred embodiment of the invention, simply by way of illustration of the best mode contemplated for carrying out my invention. As will be realized, the invention is capable of other and different embodiments, and its several details are capable of modification in various obvious respects, all without departing from the invention. Accordingly, the drawings and description are to be regarded as illustrative in nature, and not as restrictive.

BRIEF DESCRIPTION OF THE DRAWINGS

FIG. 1 is a perspective view of a preferred embodiment of the present invention illustrating the U-shaped form and the activating switches, and shown with full and dotted line positions of the pulling and stacking assembly;

FIG. 2 is a side view of the apparatus with the form loaded with a string of hose and showing two operative (full and dotted line) positions of the form;

FIG. 2*a* is a side view taken along line 2*a*—2*a* of FIG. 2 showing the free end of the form and hosiery being inflated by egress of air for drawing onto the form;

DETAILED DESCRIPTION OF THE PREFERRED EMBODIMENT

Figure 3:
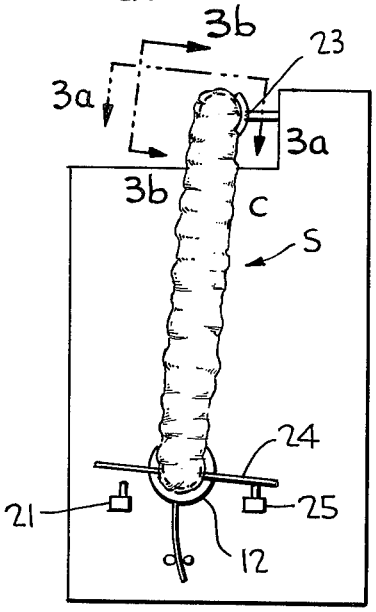
FIG. 3 is a side view like FIG. 2 but with the form shown in the separating position.

Referring generally to FIGS. 1–3, the apparatus of the present invention includes a turning, separating and stacking apparatus, generally designated by the reference numeral 10. The apparatus 10 includes a U-shaped tubular form 11 pivotally supported on one end of the machine by a suitable bearing 12. As will be seen later in detail, the form 11 moves during the operation between the full line outward, loading position A of FIG. 2 through an intermediate turning position B (dotted line, FIG. 2) to the final full line, separating position C of FIG. 3.

Pulling and stacking assembly, generally designated by the reference numeral 13, is guided for horizontal reciprocating movement by a pair of horizontal parallel rails 14. Pulling and stacking assembly 13 includes two opposed fingers 15*a*, 15*b*, for gripping and pulling the hose from the string S (see FIGS. 3*a*, 3*b*). A driven lever or other suitable driving means is used to reciprocate the carriage of the pulling and stacking assembly 13.

In order to load the string S (see FIG. 2*a*) and then to turn the hose first in-line on the string S on the U-shaped tubular form 11 (see FIGS. 3*a*, 3*b*), a reversible source of pneumatic pressure is first required. This is accomplished by feed line or tube 16 connected to the form 11 (see FIG. 4) adjacent the mounted end of the form. A two-way valve 17 selectively provides the compressed air or vacuum from the source 18 through the connections 19, 20, respectively.

Of importance, the valve 17 is automatically operated by a switch 21 when the form 11 is placed in position A (see FIG. 2). No conscious effort on the part of the operator is required to perform this important function. A suitable voltage source 22 energizes the valve.

Supplying the compressed air from source 18, through the valve 17 and out of mouth 11*a* (see FIG. 2*a*), effects temporary enlargement of the string S, i.e., the egressing air blows up each sock or hose $S_1$, $S_2$, $S_3$ . . . $S_n$ in turn as the operator's hand H moves the string on the form. This enlarged condition pre-opens the string S and thereby reduces the frictional resistance at the open mouth 11*a* of the tube 11 to enhance the speed and efficiency of the loading operation. The operator's hand H during loading is predominantly on the inner side face of the form, and thus holds the switch 21 in the position for supply of the compressed air. The operator does not resist using this important feature since she can do so without manually throwing a switch, as has been required in the past.

When the entire string S has been loaded, the form 11 is bodily oscillated from the solid line position A of FIG. 2 to the dotted line intermediate or B position. The movement of the tubular form 11 toward the dotted line position automatically releases the switch 21 to change the valve 17 for connection to the vacuum side of source 18. Immediately, ingress of air through the open mouth 11*a* begins. The operator's hand H simultaneously moves the last sock to be loaded, that is, the first in-line sock $S_n$ to be separated, toward the open end or mouth 11*a* of the tube 11. The hose is drawn into the open end of the tube 11 as it is moved off the form 11.

Figure 3B:
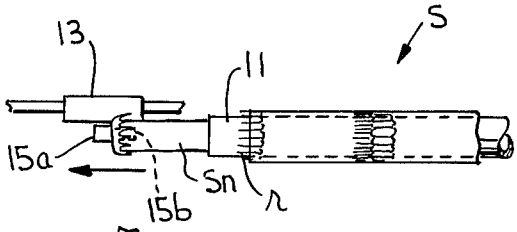
FIG. 3*b* is a side view of the form end taken along line 3*b*—3*b* of FIG. 3 with hose just having been separated.
Figure 3A:
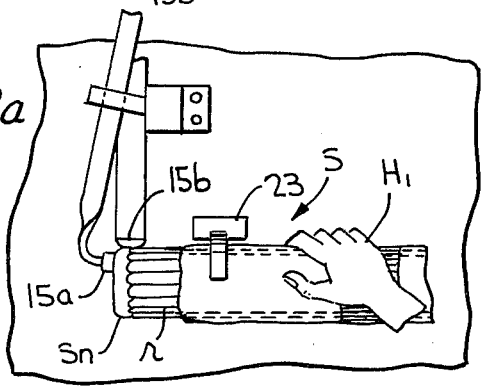
FIG. 3*a* is a top view of the end of the form taken along line 3*a*—3*a* of FIG. 3 showing the first in-line hose being grasped by the pulling and separating assembly.

When the position of the hose of FIG. 3*a* is reached, a substantial full turn of the sock is completed with the greater part within the form 11, and it is held there by the suction and the operator's hand $H_1$.

The connector rings *r* attach the hose to each other to form the string S. During separation, this ring is stopped short of the open mouth 11*a*. A doubled over portion, preferably the welt end, is thus provided in readiness to be gripped across a flattened side adjacent the open mouth 11*a* of form 11 by the grasping fingers 15*a*, 15*b*.

The operator pivots the form 11 inward to position C against positioning stop 23 just as the hose reaches the turned condition. This aligns the flattened side adjacent the open mouth 11*a* of the form 11 with the open fingers 15*a*, 15*b*. In this operative position, cross arm 24 on the tube without any further action by the operator hits and operates switch 25. Sequence operator 26 instantly activates drive motor 27 which cycles pulling and stacking apparatus 13.

In the dotted line position of FIG. 1, the pulling and stacking assembly 13 has reached the full shifted position and the grasping fingers 15*a*, 15*b* are automatically closed on the doubled over portion of the hose or sock (see FIG. 3*a*). FIG. 3*b* shows the turned and separated sock $S_n$ being withdrawn from the interior of form 11. This cycle is repeated until all of the hose are turned and removed. Each sock is carried along the path P (FIG. 1) and dropped to form a stack in the tray 28.

It should be noted in FIGS. 2 and 3 that the string S may be conveniently loaded along the entire length of the U-shaped tubular form 11, thus making the string of maximum length. To put it another way, the novel U-shaped form 11 greatly increases the holding capacity without increasing the floor space required. Efficiency is further enhanced by less down time since the strings need to be loaded less often.

The U-shaped tubular form 11 provides two large diameter bends to convert horizontal storage of the string of hosiery on one horizontal portion to vertical storage on a second portion and reverse horizontal storage on a third portion. All of the three portions and the connecting integral bends have an unobstructed outer surface, as shown in FIG. 1, to receive the string S along the entire length (see FIG. 3 and as noted above).

Form 11 is supported by bearing 12 which is affixed to the machine cabinet. Cross bar or arm 24 is utilized to automatically operate switches 21 and 25 as form 11 is vertically oscillated about its axis from the loading position A, to the vacuum or everting and inspecting position B, and finally to the separating position C.

This combination of the switches 21 and 25 has been selected to give the machine full operation without requiring the operator to throw a lever, or step on a foot switch. All that is needed is an easy, rhythmic swinging action of the form 11 in a vertical plane. The operator has both hands free to shift the string axially along the tube for both the loading and turning operations.

Figure 4:
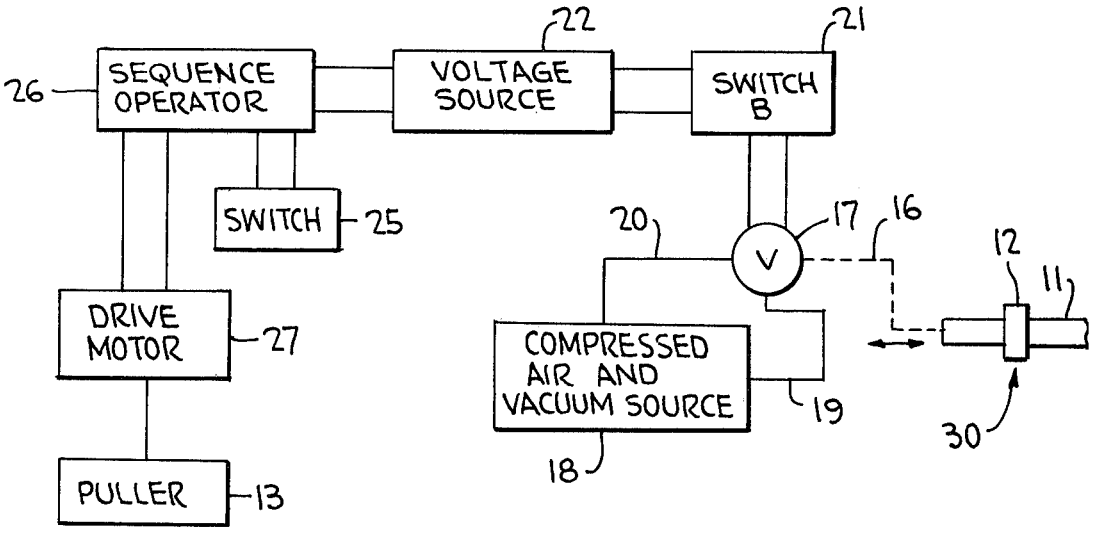
FIG. 4 is a schematic diagram of an operating circuit useful with the apparatus of the present invention and including the air reversing and the sequencing switches.

Also, the switches 21, 25 provide fail-safe accurate positioning control and precise actuation of the system and circuit of FIG. 4. Interference or snagging of the string S on the switches is impossible in our design since said switches are spaced in an out-of-the-way position. They are spaced outwardly from the tube and are operated by the elongated cross bar 24.

Leaf spring 29 and stops 30 normally maintain the form 11 in a stable, intermediate position B. After each sock is removed at the separation position C, the operator simply releases the inward push on the form (FIG. 3*a*) and can concentrate solely on bringing the next sock to the end of the form since the spring 29 automatically returns the form. When the switch 25 is released by this return action, the circuit of FIG. 4 resets itself in readiness for the next cycle.

The spring 29 also provides a safety factor in that for the form 11 to be moved to either the operative A or C positions, a conscious effort is required. Any time pressure is removed from form 11, it returns by itself to the neutral intermediate position B.

From the foregoing discussion, it can be seen that the operation of the present invention is advantageously simple and capable of rapid and efficient operation. The operator first loads the string S, which may be of maximum length, on the U-shaped form 11 in position A. Then, in position B, the compressed air that aids loading, changes to suction. Next, by a simple sliding motion, each succeeding hose or sock is brought toward the open mouth of the form 11 for turning. The operator stops the sock with a doubled over portion at the end of the form, moves the form 11 inwardly to position C and with the aid of the stop 23 holds this doubled over portion for an instant. The switch 25 is activated in response to reaching position C and the pulling and stacking assembly 13 moves to the dotted line position (FIG. 1) whereupon the opposed fingers 15*a*, 15*b* engage and securely grip said doubled over portion of each sock. The assembly 13 immediately reverses to then pull the sock off the form 11, simultaneously separating each connector ring *r*. In the same motion (see FIG. 1) each sock is moved along the delivery path P to the stacking station in the tray 28 where each sock is released and a bundle is formed.

It will thus be seen that the objects set forth above, as well as others made apparent from the preceding description, are efficiently attained. Certain changes may be made in the specific mechanisms employed in the preferred embodiment without departing from the broad scope of the invention. Thus, it is intended that all matter contained in the above description, or shown in the accompanying drawings, shall be interpreted insofar as the broad concepts are concerned, as illustrative, and not in a limiting sense.

What is claimed is:

1. Apparatus for handling hosiery comprising:

a U-shaped tubular form for receiving a string of hosiery, bearing means supporting said form for oscillation about a substantially fixed axis, means operatively connected to said form for providing suction to said tube to turn said hosiery, means for pulling, separating and stacking said hosiery from the string after said turning, and control means responsive to oscillation of said form for controlling said suction and said pulling and separating means, whereby said hosiery may be turned and separated from a string of maximum length and in response to the movement of said form.

2. The apparatus of claim 1 wherein is further provided means operatively connected to said form for providing compressed air to said tube to assist in loading.

3. The apparatus of claim 2 wherein is further provided first switch means to alternately connect said suction means in a first position of said form and said compressed air means in a second position.

4. The apparatus of claim 3 wherein is further provided second switch means to activate said pulling, separating and stacking means in a third position.

5. The apparatus of claim 4 wherein said form is supported substantially horizontally at one end in said bearing means, the other end of said form being left free to receive said string.

6. The apparatus of claim 5 wherein is further provided a cross bar mounted on said form adjacent said bearing means, said cross bar serving to alternately operate said first and second switch means.

7. The apparatus of claim 6 wherein is further provided a spring to return said form to the second position when released.

8. Handling and turning apparatus for a string of hosiery comprising:

support means;

a tubular form having an end mounted on said support means with an end free for receiving said hosiery string, said form including at least one portion having the free end, a second portion at an angle to said first portion, and a bend connecting the two portions, the surface of said portions and said bend being substantially unobstructed to receive said hosiery string, and pneumatic means connected to said form to at least turn said hosiery.

9. The handling and turning apparatus of claim 8 wherein said form further includes a third portion extending at an angle to said second portion with a bend connecting said portions, said bends forming substantially right angles, the mounted end of said form being on said third portion and substantially horizontal, and said support means includes bearing means for said form to allow substantially free oscillating movement in a vertical plane.

10. The handling and turning apparatus of claim 9 wherein is provided switch means positioned to be activated by oscillation of said form to control said pneumatic means.

11. The handling and turning apparatus of claim 10 wherein said pneumatic means includes suction and air pressure means to both turn and assist in loading on said form.

* * * * *